US006551082B2

(12) United States Patent
Douzono et al.

(10) Patent No.: US 6,551,082 B2
(45) Date of Patent: Apr. 22, 2003

(54) OIL FREE TYPE SCREW COMPRESSOR

(75) Inventors: Kenji Douzono, Shimizu (JP); Hitoshi Nishimura, Shimizu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/811,386

(22) Filed: Mar. 20, 2001

(65) Prior Publication Data

US 2003/0059326 A1 Mar. 27, 2003

(30) Foreign Application Priority Data

Nov. 22, 2000 (JP) ..... 2000-360701

(51) Int. Cl.[7] ..... F01C 21/04

(52) U.S. Cl. ..... 418/83; 418/9; 418/418; 418/85; 418/88; 418/89; 418/201.1

(58) Field of Search ..... 418/85, 9, 201.1, 418/88, 89, 83

(56) References Cited

U.S. PATENT DOCUMENTS

| | | | | | |
|---|---|---|---|---|---|
| 4,529,363 | A | * | 7/1985 | Suzuki | 418/83 |
| 4,725,210 | A | * | 2/1988 | Suzuki et al. | 418/83 |
| 4,929,161 | A | * | 5/1990 | Aoki et al. | 418/83 |
| 5,263,832 | A | * | 11/1993 | Yamaguchi | 418/88 |
| 5,618,164 | A | * | 4/1997 | Holzheimer et al. | 417/68 |

FOREIGN PATENT DOCUMENTS

| | | | | |
|---|---|---|---|---|
| EP | 460578 | * | 12/1991 | 418/201.1 |
| JP | 03-088989 | * | 4/1991 | 418/201.1 |
| JP | 06-081782 | * | 3/1994 | 418/201.2 |

OTHER PUBLICATIONS

Japanese Patent Unexamined Publication No. 11–22688.
Japanese Patent Unexamined Publication No. 11–336684.
Japanese Patent Unexamined Publication No. 1–116297.
U.S. patent application Ser. No. 09/671,305.
U.S. patent application Ser. No. 09/391,088.

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

In an oil-free type screw compressor including a low-pressure-stage compressor main body and a high-pressure-stage compressor main body, when the power of an motor is transmitted to an oil pump via a gear to start the pump, the lubrication oil stored in an oil sump formed at the bottom of a gear casing flows through an oil strainer. A part of the oil is introduced to an oil cooler, while the rest is introduced to a junction portion by bypassing the oil cooler. Further, a part of the oil introduced to the oil cooler is directed to the junction portion. After adjusting the temperature of the oil appropriately, it is introduced to a lubrication portion of the compressor, while the oil cooled by the oil cooler using the full capacity thereof is introduced to oil jackets of the compressor main bodies via different passages.

17 Claims, 1 Drawing Sheet

OIL FREE TYPE SCREW COMPRESSOR

BACKGROUND OF THE INVENTION

The present invention relates to a screw compressor and more particularly to an oil-free type screw compressor having an oil-free structure in which no liquid lubricant is used in a passage for compressed air, so that it is possible to supply oil-free compressed air.

Since the oil-free type screw compressor does not have a means for reducing heat generated by the compression of the operating gas in a flow passage therefor, a casing which accommodates a male rotor and a female rotor becomes hot. For that reason, the casing is provided with an air cooling fin or a cooling jacket on the outer periphery thereof so as to prevent the casing from becoming extraordinarily hot. JP-A-11-22688 and JP-A-11-33684 disclose that the casing is provided with a cooling jacket on the outer periphery thereof and the industrial water or coolant is introduced in the cooling jacket. Further, in order to eliminate the need for the cooling water, JP-A-1-116297 discloses that the casing is cooled by introducing lubrication oil for lubricating a gear and a bearing into the cooling jacket.

The above conventional oil-free type screw compressor provided with an air cooling fin on the casing, for example, requires a large number of fins to keep a radiation area sufficiently, so that it has a disadvantage that the casing becomes large in order to provide an increased surface area. Further, in the case that the casing is provided with the water cooling jacket, as described in JP-A-11-22688, although there is an advantage that the casing can be efficiently cooled by using a relatively simple means if the industrial water or the like is easily available, it is unsuitable for the case that the industrial water is not easily available. In the case that the industrial water is unavailable, although it is possible to use coolant for the cooling as described in JP-A-11-336684, it is also required to prepare a special solution as coolant and a cooling means for cooling the coolant increased in temperature by the cooling of the casing, thus, it causes a disadvantage that the apparatus is complicated.

On the contrary, an apparatus for cooling the casing with the lubrication oil as disclosed in JP-A-1-116297 uses the lubrication oil, which is necessarily required for the compressor, for its cooling, so that it can advantageously cool the compressor main body easily, even if the industrial water is unavailable.

In the apparatus, the lower the temperature of the lubrication oil for cooling the compressor main body is, the better the cooling efficiency is, while the temperature of the lubrication oil is preferably maintained at about 55° C. for lubricating a bearing or a gear, as is an appropriate lubrication oil feeding temperature. Since it is difficult to realize these two types of temperatures by a single oil cooler, the apparatus has been provided with two oil coolers, or the lubrication oil has been cooled down to a temperature at which it is supplied to the cooling jacket, that is, the lower temperature.

In the latter case, the lubrication oil to be fed to a bearing and a gear is excessively cooled to increase mechanical loss, and further, the apparatus necessarily requires a larger-sized oil cooler. This prevents the reduction of the size of a package type of oil-free compressor.

Further, in the conventional oil-free type screw compressors, if casting sand or the like entering the apparatus during the casing manufacturing process remains in the compressor main body or the gear casing, the casting sand is introduced to the bearing or the gear when the lubrication oil is circulated, so that the bearing and the gear may be damaged.

BRIEF SUMMARY OF THE INVENTION

The present invention is provided in view of the above disadvantages of the prior art. It is an object of the invention to provide a reliable oil-free type screw compressor. It is another object of the invention to cool the compressor main body of the oil-free type screw compressor by simple structure. Also, it is an object of the invention to provide a small and inexpensive package type oil-free screw compressor. The present invention attains at least one of these objects.

In order to attain the above objects, according to one aspect of the present invention, there is provided an oil-free type screw compressor comprising a low pressure stage compressor main body and a high pressure stage compressor main body each having a cooling jacket for the cooling by oil; a first passage for supplying the lubrication oil to a bearing and/or a timing gear in each compressor main body; a second passage for supplying the lubrication oil to each cooling jacket for cooling the compressor main body; and an oil sump for accommodating the lubrication oil which has passed through the first or second passage, wherein the lubrication oil passing through the second passage is introduced into the oil sump without passing through the first passage.

In the oil-free type screw compressor, the lubrication oil passing through the first passage may be introduced into the oil sump without passing through the second passage, or the compressor may further comprise an oil cooler capable of cooling the lubrication oil to two different temperatures so that the lubrication oil with the lower-temperature is introduced to the second passage and the lubrication oil with the higher-temperature is introduced to the first passage. Further, a lubrication oil flow passage in the oil cooler may be provided with a branch portion midway thereof so that the lubrication oil with the higher-temperature is supplied from the branch portion.

In order to attain the above objects, according to another aspect of the present invention, there is provided an oil-free type screw compressor comprising a compressor main body provided with a cooling jacket; an electric motor for driving the compressor main body; a gear casing for accommodating a gear set which transmits the rotation of the electric motor to the compressor main body while changing the rotational speed, the gear casing having an oil sump formed in the bottom thereof; an oil pump for feeding lubrication oil from the oil sump to the cooling jacket; an oil cooler for cooling the lubrication oil fed from the oil pump; and a lubrication pipe branching from midway of a lubrication oil flow passage in the oil cooler, thorough which the lubrication oil is supplied to a timing gear and/or a bearing in the compressor main body.

In this oil-free type screw compressor, the compressor may comprise a pipe branching from the lubrication pipe for supplying the lubrication oil to the gear set in the gear casing; the oil cooler may supply two types of lubrication oils with different temperatures; the lubrication oil with the lower-temperature supplied from the oil cooler may be supplied to the cooling jacket; the compressor may comprise a pipe for directly returning the lubrication oil which has cooled the cooling jacket to the oil sump; the compressor may comprise an air cooling fan for cooling the oil cooler by air; the oil pump may be disposed upstream from the oil cooler; the lubrication pipe may be provided with a filter apparatus midway thereof; and the compressor may comprise a return pipe for introducing a part of the lubrication oil, fed from the oil pump, to the gear casing without passing through the oil cooler, and a junction at which the lubrication oil which has passed through the return pipe and the lubrication oil which has passed through the lubrication pipe branching from midway of the oil cooler join.

In order to attain the above objects, according to yet another aspect of the present invention, there is provided an oil-free type screw compressor comprising a compressor main body provided with a cooling jacket; an oil cooler for cooling lubrication oil, through which the lubrication oil is supplied to a lubrication point in the compressor main body and to the cooling jacket; and a branch pipe branching from midway of a lubrication oil flow passage in the oil cooler, thorough which the lubrication oil is supplied to the lubrication point.

In order to attain the above objects, according to still another aspect of the present invention, there is provided an oil-free type screw compressor comprising a compressor main body provided with a cooling jacket; an oil cooler for cooling lubrication oil; and an oil sump for storing the lubrication oil, from which the lubrication oil is supplied through the oil cooler to a lubrication point in the compressor main body and to the cooling jacket, wherein a part of the lubrication oil supplied from the oil sump is supplied to the lubrication point without passing through the oil cooler.

An embodiment of the present invention will be explained below with reference to the drawings.

DETAILED DESCRIPTION OF THE INVENTION

Figure 1:
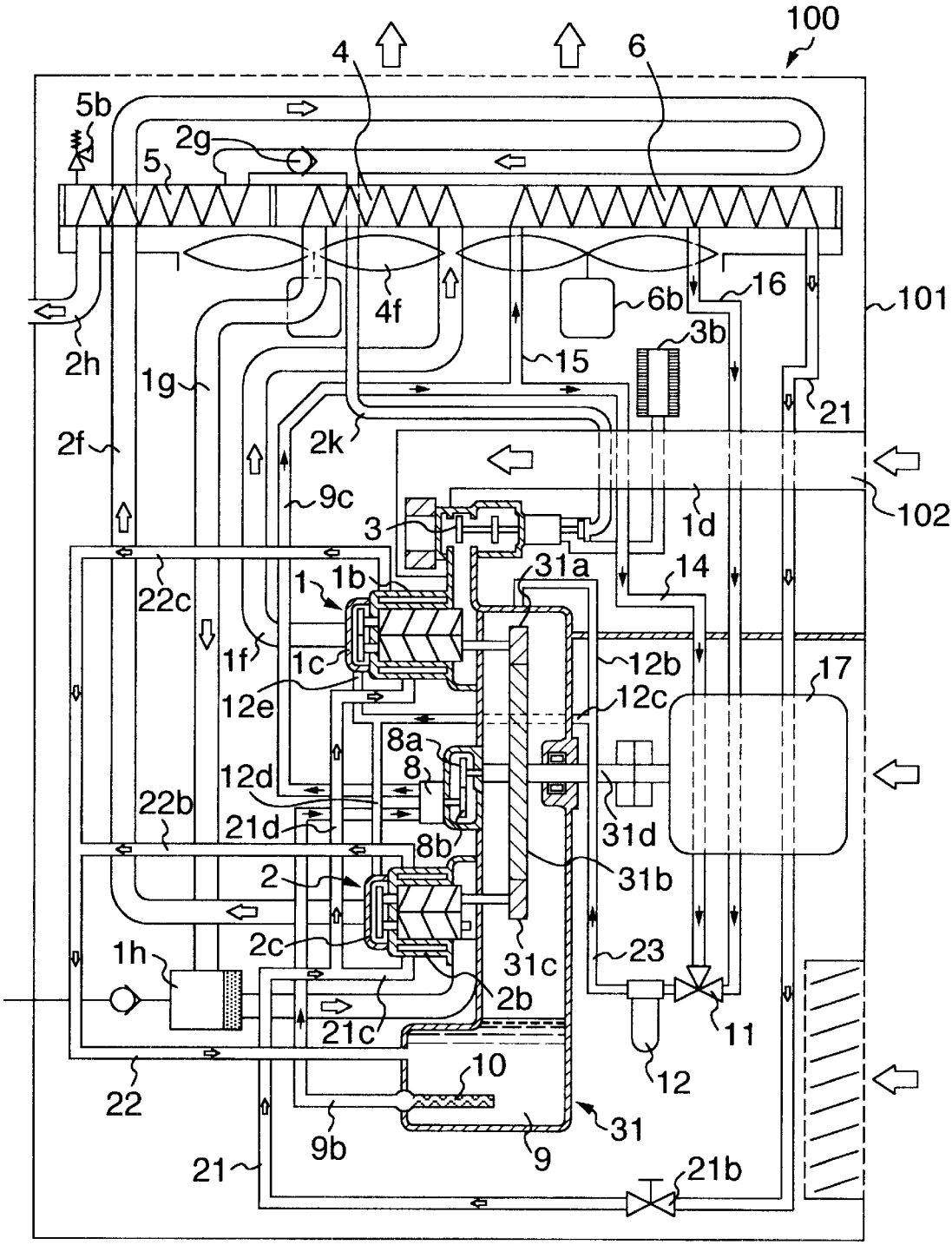
FIG. 1 is a systematic diagram illustrating one embodiment of a two-stage oil-free type screw compressor according to the present invention.

FIG. 1 is a systematic diagram illustrating a two-stage package type of oil-free screw compressor 100 provided with a low-pressure-stage compressor main body and a high-pressure-stage main body. The low-pressure-side compressor main body 1 comprises a pair of a male rotor and a female rotor held in a casing 1*c* having a cooling jacket 1*b* around its outer periphery. A rotating shaft of each of the male rotor and the female rotor has a timing gear attached to one end thereof, and a pinion 31*a* attached to the other end. The low-pressure-stage compressor main body 1 has, on its suction side, an inlet flow passage 1*d* for introducing ambient air sucked through a suction port 102 formed in an enclosure 101 of the package-type oil-free compressor 100 into the low-pressure-stage compressor main body 1, and a suction throttle valve 3 for controlling the amount of ambient air introduced into the low-pressure-stage compressor main body 1.

The low-pressure-stage compressor main body 1 is connected at the ejection side to one end of a pipe 1*f* of which the other end is connected to an intercooler 4. The intercooler 4 is connected to one end of a pipe 1*g* of which the other end is connected to a suction side of the high-pressure-stage compressor 2. The pipe 1*g* has a demister 1*h* disposed midway thereof. In the same way with the low-pressure-stage compressor 1, the high-pressure-stage compressor 2 also has a pair of a male rotor and a female rotor held in a casing 2*c* having a cooling jacket 2*b* formed around an outer periphery thereof. The male and female rotors have a timing gear attached to one shaft end thereof, and a pinion 31*c* attached to the other shaft end.

The pinion 31*c* attached to the rotors of the high-pressure-stage compressor main body 2 and the pinion 31a attached to the rotors of the low-pressure-stage compressor main body 1 mesh with a bull gear 31*b* attached to a rotating shaft 31*d* connected to a rotating shaft of an electric motor 17 by a coupling. The rotating shaft 31*d* also has a gear 8*a* attached to its shaft end opposite to the other shaft end connected to the electric motor 17, so that the gear 8*a* mesh with the gear 8*b* attached to a shaft end of the oil pump 8. The pinions 31*a* and 31*c* and the bull gear 31*b* are accommodated in the gear casing 31.

The discharge side of the high-pressure-stage compressor main body 2 is connected to a pipe 2*f* provided with a check valve 2*g* midway thereof. One end of the pipe 2*f* is connected to an after cooler 5 so that compressed air cooled by the after cooler 5 is supplied to a utilization side via a pipe 2*h*.

The operation of the package-type oil-free compressor 100 according to the present embodiment including the air piping system having the above construction will be described below. When the electric motor 17 is activated, the ambient air is introduced through the suction port 102 to the inlet flow passage 1*d*, and the flow rate thereof is adjusted by the suction throttle valve 3. After that, the air is pressurized up to about 0.18 MPa in the low-pressure-stage compressor main body 1, so that the temperature of the air rises up to about 160° C. The compressed air having the increased pressure and temperature is guided via the pipe 1*f* to the intercooler 4, where the compressed air exchanges the heat with cooling air blown from a cooling fan 4*f* arranged on a front side (the lower side in the drawing) of the intercooler 4, so that the compressed air is cooled down to a temperature higher than the ambient temperature by about 18° C.

The moisture included in the compressed air cooled by the intercooler 4 is separated therefrom by means of the demister 1*b* provided midway of the pipe 1*g* and is then introduced to the high-pressure-stage compressor main body 2. In the high-pressure-stage compressor main body 2, the pressure is increased up to 0.69 MPa and the temperature is also increased to about 200° C. This hot, pressurized and compressed air is guided to pass thorough the pipe 2*f* at a rear side (the upper side in the drawing) of the after cooler 5, the intercooler 4 and an oil cooler described below for precooling, and thereafter exchanges the heat with the cooling air blown from the cooling fan 4*f* provided on the front side of the after cooler 5 so that the temperature of the pressurized air is lowered. The pressurized air cooled in the after cooler 5 down to the temperature higher than the ambient temperature by about 15° C. is supplied to the utilization side through the pipe 2*b*. If the pressure of the compressed air fed from the high-pressure-stage compressor main body 2 exceeds a set value, a part of the compressed air cooled by the after cooler 5 is blown off from a safety valve 5*b*. FIG. 1 shows the flow of the air by using white large arrows.

The compressed air is also guided to a rear side of the suction throttle valve 3 via a pipe 2*k* branching from midway of the pipe 2*f*. The compressed air is blown off from a blow-off silencer 3*b* when the high-pressure-stage compressor main body 2 is operated under no load or with a partial load. Additionally, for operating the suction throttle valve 3, the compressed air is guided to the suction throttle valve 3 through a pipe (not illustrated) so as to throttle its air flow passage during the no-load or partial-load operation.

Next, a lubrication line of this two-stage oil-free screw compressor will be described in detail. When the electric motor 17 is activated, the oil pump 8 is started so that the lubrication oil stored in an oil sump 9 formed at the bottom of the gear casing 31 is fed to the oil pump 8 through a pipe 9*b* while a contaminant or the like in the oil is removed by an oil strainer 10. A part of the lubrication oil increased in pressure up to about 0.15 MPa by the oil pump 8 is guided to the oil cooler 6 through a pipe 15 branching from a pipe 9*c*. In the oil cooler 6, the lubrication oil exchanges the heat with cooling air blown from the cooling fan 6*b* arranged on the front side (the underside in the drawing) of the oil cooler 6. The rest of the lubrication oil which has flown through the pipe 9*c* is guided to a pipe 14 as a bypass passage of the oil cooler 6. The lubrication oil introduced in the oil cooler 6 is cooled down to two types of temperature levels depending on the purpose of use.

The first temperature level is equal to the temperature for lubricating a bearing and a gear portion. As described above, in the case of lubricating the bearing for supporting the male and female rotors, the timing gear, the pinions 31*a* and 31*b*, and the bull gear 31*c* which are provided in the low-pressure-stage compressor main body 1 or the high-pressure-stage compressor main body 2, the lubrication oil is set at a temperature suitable for the lubrication. Thus, the lubrication oil taken from midway of the oil cooler 6 by a pipe 16 and the lubrication oil guided to the pipe 14 so as to bypass the oil cooler 6 are joined together at a junction 11, and those flow rates are regulated, so that the temperature of the oil is adjusted, e.g., at 55° C. In this adjustment, when the temperature of the lubrication oil flowing from the oil pump 8 into the junction 11 is higher than a predetermined temperature, the flow passage of the pipe 14 is throttled to increase the amount of lubrication oil flowing to the oil cooler 6. On the other hand, when the temperature of the lubrication oil flowing from the oil pump 8 is lower than a predetermined temperature, the flow passage of the pipe 14 is enlarged to reduce the amount of lubrication oil flowing to the oil cooler 6.

As a result, the lubrication oil supplied to the bearing and gear portions is adjusted so as to have a temperature suitable for the lubrication. After removing the impurities in the lubrication oil by means of the oil filter 12 for the purification, the lubrication oil is introduced to the pinions 31*a* and 31*c* and bull gear 31*b* in the gear casing 31 through a pipe 12*b* branching from a pipe 23. Further, a pipe 12*c* branching from the pipe 23 further branches into two, while the purified and temperature-controlled lubrication oil is guided to the timing gear and bearing of the low-pressure-stage compressor main body 1 through one pipe 12*e* of the branching pipes, and to the timing gear and bearing of the high-pressure-stage compressor main body 2 through the other pipe 12*d* of the branching pipes. The lubrication oil which has lubricated the low-pressure-stage compressor main body 1 and the high-pressure-stage compressor main body 2 returns to the oil sump portion 9 in the gear casing 31 through a pipe (not illustrated). FIG. 1 shows this lubrication oil system by using small arrows.

On the other hand, the flow rate of the lubrication oil cooled by the oil cooler 6 using its full capacity is adjusted by a control valve 21*b* provided midway of a pipe 21, and then branches into a pipe 21*c* connected to the cooling jacket 2*b* of the high-pressure-stage compressor main body 2 and a pipe 21*d* connected to the cooling jacket 1*b* of the low-pressure-stage compressor main body 1. The lubrication oil which has cooled the low-pressure-stage compressor main body 1, and the lubrication oil which has cooled the high-pressure-stage compressor main body 2 pass through a pipe 22*c* and a pipe 22*b* respectively and are jointed together in a return pipe 22. Also, the joined lubrication oil returns to the oil sump portion 9 formed at the bottom of the gear casing 31. FIG. 1 shows this lubrication oil line for the cooling by using small white arrows.

Because the present embodiment having the construction as described above uses the lubrication oil for cooling the compressor main bodies 1 and 2, it is possible to eliminate the need for a coolant or cooling water and to simplify the cooling structure. Further, because the two types of lubrication oils with different temperatures can be supplied for cooling the compressor main bodies 1 and 2 and for lubricating the lubrication parts in the oil-free compressor 100, the lubrication oil supplied to the lubricated portions is prevented from being excessively cooled. Furthermore, because the compressor main bodies are prevented from being insufficiently cooled, it is possible to use an appropriate-sized oil cooler, so that the size and the heat transmission area of the oil cooler can be reduced.

As a result, a low-cost oil-free screw compressor can be realized. Further, because the lubrication oil for the cooling, which is fed into the jackets 1*b* and 2*b* of the compressor main bodies, and the lubrication oil supplied to the bearings and gears have different temperatures, and the two flows of the lubrication oils with the different temperatures are joined together and introduced to the oil sump formed at the bottom of the gear casing, it is possible to reduce the temperature of the lubrication oil and to lessen the radiation from the surface of the gear casing. Further, because the different lines (systems) are used in order to cool the compressor main bodies 1 and 2 and to lubricate the lubricated parts in the oil-free compressor 100 respectively, and the oil filter is provided in those lines, it is possible to prevent impurities such as casting sand entering the casing of the compressor main bodies or the gear casing during the production thereof from flowing into the lubricated portions such as gears and bearings which are precision parts. Accordingly, the lubricated portions can be prevented from being damaged by foreign matter so that the reliability is improved.

In the present embodiment, although the two-stage type oil-free screw compressor has been described as an example, the present invention is not limited to this, but also applicable to a so-called air cooling type oil-free screw compressors as long as similar effects are expected.

According to the invention, since the lubrication oil is used to cool the compressor main bodies and to lubricate the oil-free compressor, and is circulated through the two circulation lines with the different temperatures as described above, it is possible to realize a reliable oil-free screw compressor. Further, since no coolant or cooling water is required, it is possible to cool the compressor main bodies of the oil-free screw compressor by using a simple structure. Moreover, since the oil cooler is reduced in size and no coolant cooler is required, a small and low-cost package-type oil-free screw compressor can be implemented. The present invention can achieve at least one of the above described effects.

What is claimed is:

1. An oil-free type screw compressor comprising:

a low pressure stage compressor main body and a high pressure stage compressor main body each having a cooling jacket for the cooling by oil;

a first passage for supplying the lubrication oil to a bearing and/or a timing gear in each compressor main body;

a second passage for supplying the lubrication oil to each cooling jacket for cooling the compressor main body;

an oil sump for accommodating the lubrication oil which has passed through the first or second passage; and an oil cooler capable of cooling the lubrication oil to two different temperatures, wherein the lubrication oil passing through the first passage is introduced into the oil sump without passing through the second passage, and wherein the lubrication oil with the lower-temperature is introduced to the second passage, and the lubrication oil with the higher-temperature is introduced to the first passage.

2. The oil-free type screw compressor according to claim 1, wherein a lubrication oil flow passage in the oil cooler is provided with a branch portion between ends of the lubrication oil flow passage, and the lubrication oil with the higher-temperature is supplied from the branch portion.

3. The oil-free screw compressor according to claim 2, wherein the branch portion is located midway along the lubrication oil flow passage.

4. An oil-free type screw compressor comprising a low pressure stage compressor main body and a high pressure stage compressor main body each having a cooling jacket for the cooling by oil;

a first passage for supplying the lubrication oil to a bearing and/or a timing gear in each compressor main body;

a second passage for supplying the lubrication oil to each cooling jacket for cooling the compressor main body;

an oil sump for accommodating the lubrication oil which has passed through the first or second passage; and an oil cooler capable of cooling the lubrication oil to two different temperatures wherein the lubrication oil passing through the second passage is introduced into the oil sump without passing through the first passage, wherein the lubrication oil passing through the first passage is introduced into the oil sump without passing through the second passage, and wherein the lubrication oil with the lower-temperature is introduced to the second passage, and the lubrication oil with the higher-temperature is introduced to the first passage.

5. The oil-free type screw compressor according to claim 4, wherein a lubrication oil flow passage in the oil cooler is provided with a branch portion between ends of the lubrication oil flow passage, and the lubrication oil with the higher-temperature is supplied from the branch portion.

6. The oil-free screw compressor according to claim 5, wherein the branch portion is located midway along the lubrication oil flow passage.

7. An oil-free type screw compressor comprising:

a compressor main body provided with a cooling jacket;

an electric motor for driving the compressor main body;

a gear casing for accommodating a gear set which transmits the rotation of the electric motor to the compressor main body while changing the rotational speed, the gear casing having an oil sump formed in the bottom thereof;

an oil pump for feeding lubrication oil from the oil sump to the cooling jacket;

an oil cooler for cooling the lubrication oil fed from the oil pump; and a lubrication pipe branching from a branch portion located between ends of a lubrication oil flow passage in the oil cooler, through which the lubrication oil is supplied to a timing gear and/or a bearing in the compressor main body.

8. The oil-free type screw compressor according to claim 7, wherein the compressor comprises a pipe branching from the lubrication pipe for supplying the lubrication oil to the gear set in the gear casing.

9. The oil-free type screw compressor according to claim 7, wherein the oil cooler supplies two types of lubrication oils with different temperatures.

10. The oil-free type screw compressor according to claim 9, wherein the lubrication oil with the lower-temperature supplied from the oil cooler is supplied to the cooling jacket.

11. The oil-free type screw compressor according to claim 7, wherein the compressor comprises a pipe for directly returning the lubrication oil which has cooled the cooling jacket to the oil sump.

12. The oil-free type screw compressor according to claim 7, wherein the compressor comprises an air cooling fan for cooling the oil cooler by air.

13. The oil-free type screw compressor according to claim 7, wherein the oil pump is disposed upstream from the oil cooler.

14. The oil-free type screw compressor according to claim 7, wherein the lubrication pipe is provided with a filter apparatus.

15. The oil-free type screw compressor according to claim 7, wherein the compressor comprises a return pipe for introducing a part of the lubrication oil, fed from the oil pump, to the gear casing without passing through the oil cooler, and a junction at which the lubrication oil which has passed through the return pipe and the lubrication oil which has passed through the lubrication pipe branching from midway of the oil cooler join.

16. The oil-free screw compressor according to claim 7, wherein the branch portion is located midway along the lubrication oil flow passage.

17. An oil-free type screw compressor comprising:

a compressor main body provided with a cooling jacket;

an oil cooler for cooling lubrication oil; and an oil sump for storing the lubrication oil, from which the lubrication oil is supplied through the oil cooler to a lubrication point in the compressor main body and to the cooling jacket, wherein a part of the lubrication oil supplied from the oil sump is supplied to the lubrication point without passing through the oil cooler.

* * * * *